US006776314B2

(12) United States Patent
Odet

(10) Patent No.: US 6,776,314 B2
(45) Date of Patent: Aug. 17, 2004

(54) CLOSURE DEVICE FOR CONTAINER

(75) Inventor: Philippe Odet, Saint-George-de-Reneins (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 74 days.

(21) Appl. No.: 10/181,740

(22) PCT Filed: Feb. 5, 2001

(86) PCT No.: PCT/FR01/00339

§ 371 (c)(1),
(2), (4) Date: Oct. 3, 2002

(87) PCT Pub. No.: WO01/58774

PCT Pub. Date: Aug. 16, 2001

(65) Prior Publication Data

US 2003/0150191 A1 Aug. 14, 2003

(30) Foreign Application Priority Data

Feb. 9, 2000 (FR) ..... 00 01610

(51) Int. Cl.[7] ..... B65D 47/10

(52) U.S. Cl. ..... 222/541.5; 222/153.02; 222/545; 215/235; 220/257.1; 53/285

(58) Field of Search ..... 222/153.2, 153.07, 222/153.14, 541.5, 541.6, 541.9, 545, 546, 555, 1; 215/235, 253, 254; 220/257.1, 258.2; 53/285

(56) References Cited

U.S. PATENT DOCUMENTS 4,682,702 A * 7/1987 Gach ..... 222/541.9
4,984,716 A * 1/1991 Beck ..... 222/153.07
5,785,209 A * 7/1998 Guglielmini ..... 222/153.07
5,839,611 A * 11/1998 Obadia et al. ..... 222/153.14
6,283,317 B1 * 9/2001 Benoit-gonin et al. ..... 215/235
6,454,126 B1 * 9/2002 Battegazzore ..... 222/23
6,550,626 B1 * 4/2003 Randall ..... 215/253
6,619,492 B2 * 9/2003 Battegazzore ..... 215/21

FOREIGN PATENT DOCUMENTS

| | | |
|---|---|---|
| EP | 0320808 | 6/1989 |
| FR | 1399102 | 9/1965 |
| FR | 2113896 | 6/1972 |
| FR | 2777542 | 10/1999 |

* cited by examiner

*Primary Examiner*—Melvin A. Cartagena
(74) *Attorney, Agent, or Firm*—Dowell & Dowell P.C.

(57) ABSTRACT

The invention concerns a device comprising a pourer, adapted to be mounted on the container neck, and an assembly forming a cover adapted to be mounted on said neck and comprising a cap mobile between a first position where it isolates the neck and the pourer from outside and a second position providing access to the neck and the pourer. The assembly forming a cover comprises two catching string rims (411, 412) extending radially inwards from a ring (41), one first string rim (411) being adapted to be engaged with an external flange (26) of the neck (2) while a second string rim (412) is adapted to be engaged with an external flange (36) of the pourer (3), said string rims (411, 412) defining between them a volume (V) for receiving the flanges (26, 36).

10 Claims, 6 Drawing Sheets

CLOSURE DEVICE FOR CONTAINER

The invention relates to a closure device for a container and to a container equipped with such a device.

It is known to make containers for liquid, such as milk bottles made of plastics material, for example high density polyethylene. In order to avoid liquid dripping while being poured from the neck of the container, it is known to equip this neck with a pourer forming a surface for flow of the liquid. Such a pourer may be clipped on the neck. Now, taking into account the thickness of the neck and of the body of the container, the latter tend to be deformed when the pourer is clipped on. In addition, a container is generally equipped with a cap. When this cap is opened, the pourer is sometimes disconnected with respect to the neck, which imposes on the user tiresome manipulations for returning the pourer into position on a container already filled with liquid, hence considerable risks of the container tipping over and the liquid that it contains spilling.

It is a particular object of the invention to overcome these drawbacks by proposing a closure device equipped with a pourer, which comprises means for efficient catching of an assembly forming a cover and equipped with a cap, as well as with a pourer on the neck of the container, these means not involving too great a risk of deformation of the neck when the device is positioned, nor risk of disconnection of the device with respect to the neck in the course of use.

In this spirit, the invention relates to a device of the afore-mentioned type in which the assembly forming a cover comprises two catching string rims, extending radially inwards from a ring, a first rim being adapted to be engaged with an external flange of the neck, while a second rim is adapted to be engaged with an external flange of the pourer, these first and second rims defining between them a volume for receiving these flanges.

Thanks to the invention, the ring of the assembly forming cover makes it possible to immobilize the flange of the pourer and the flange of the neck in the volume defined between the catching rims, which guarantees a locking by cooperation of shapes of the assembly forming cover and of the pourer on the neck.

According to an advantageous aspect of the invention, the afore-mentioned catching edges are adapted to exert on the afore-mentioned flanges a force opposing their relative spacing apart. This force, which may be elastic due to the nature of the materials constituting the neck and the assembly forming cover, allows the flanges to be pressed one towards the other.

According to other advantageous aspects of the invention, the device incorporates one or more of the following characteristics:

The first rim forms an inclined surface with respect to a central axis of the device, this surface being flared in the direction of the body of the container. This surface which may be truncated in the case of a cylindrical neck and ring, facilitates clipping of the ring on the neck as it constitutes a ramp for radial expansion of the ring.

The rims each form a surface substantially perpendicular to a central axis of the device. These surfaces perpendicular to the central axis, which are annular in the case of a cylindrical ring, form means for efficient locking of the flanges against the ring. These surfaces may be provided to be opposite each other and the volume for receiving the flanges to be defined between them.

The flange of the pourer extends radially outwards from an edge of a skirt formed by this pourer and adapted to cover the neck. In that case, the skirt advantageously forms an inclined surface with respect to a central axis of the device, this surface being adapted to come into surface abutment against a corresponding inclined surface outside the neck.

The ring extends, opposite the cap, by a skirt adapted to come into abutment against an outer surface of a part of the container. This skirt makes it possible to mask the zone of transition between the assembly forming cover and the body of the container.

The pourer is arranged at least partially inside the neck, while the cap is provided with a skirt extending, in the afore-mentioned first position and from an inner surface of the cap, up to the level of an edge of the neck, the skirt being adapted to exert in the first position and against an inner radial surface of the pourer a force tending to apply this pourer against this edge. This skirt makes it possible to produce a tight assembly between the cap and the pourer by radial expansion of the pourer and compression against the edge of the neck.

The invention also relates to a container for liquid, particularly a plastic bottle, equipped with a closure device as described previously. Such a container is easier to manufacture than those of the state of the art, without risk of deformation of the neck when the pourer is being positioned, while the pourer does not risk being disconnected from the neck when the container is being used.

The invention will be more readily understood and other advantages thereof will appear more clearly in the light of the following description of a form of embodiment of a closure device in accordance with its principle, given solely by way of example and made with reference to the accompanying drawings, in which.

Figure 1:
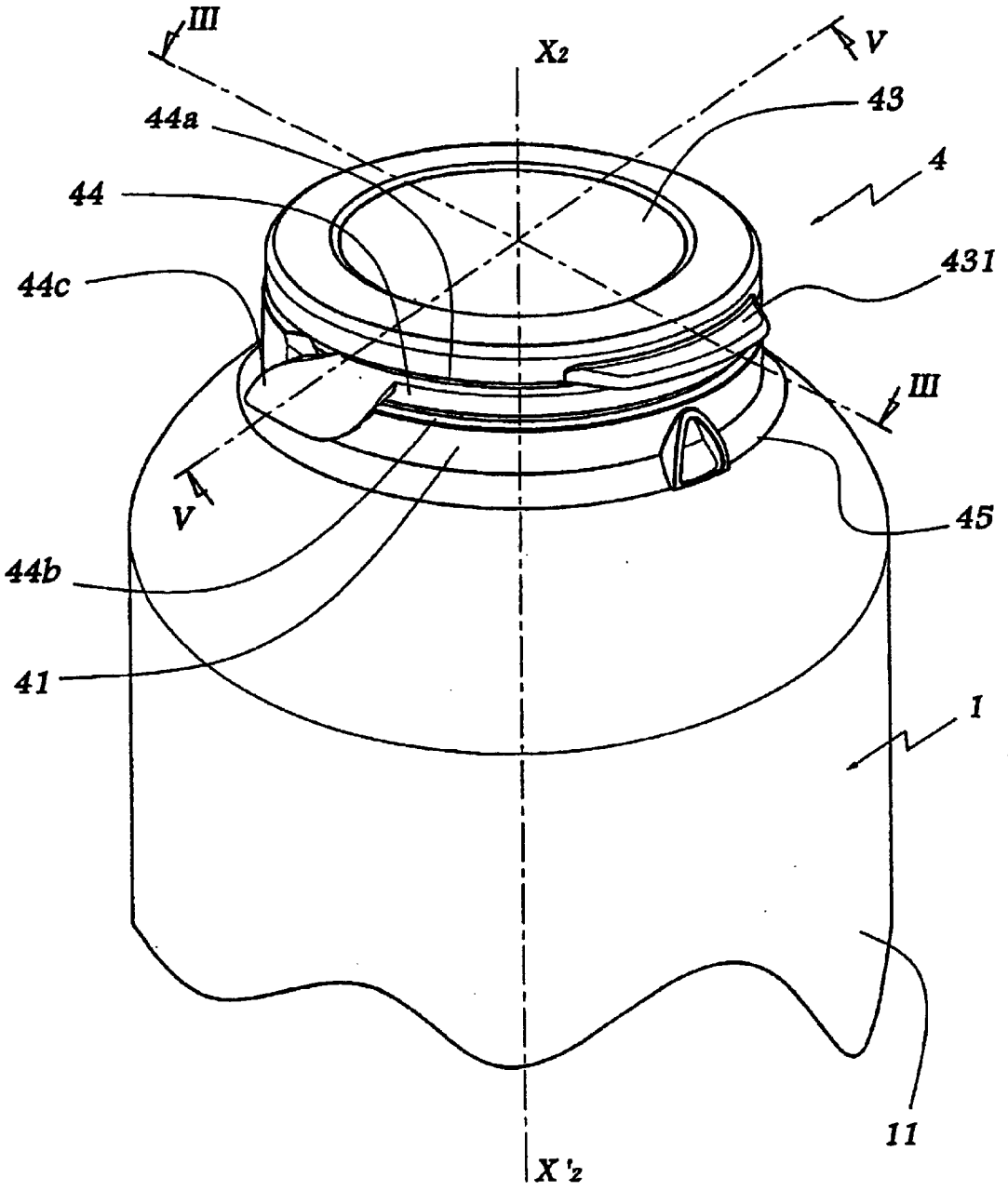
FIG. 1 is a view in perspective of an upper part of a milk bottle according to the invention, equipped with a closure device according to the invention of which the cap is in a first position.

The bottle 1 shown in the Figures is a bottle intended to contain milk, made by blowing a parison of high density polyethylene. The cost price of such a bottle is attractive while it efficiently performs its function of container.

The neck 2 of this bottle is cylindrical and $X_2$–$X'_2$ denotes its axis of symmetry. This neck has a curved generatrix and it forms a substantially annular surface 21 of which the inner end constitutes the edge 22 of the neck 2, the surface 21 extending opposite the edge 22 by a cylindrical part 23 with rectilinear generatrix itself joined to a truncated part 24 by a transition zone 25. Opposite the zone 25, the part 24 forms a flange 26 extending radially outwards as the part 24 is convergent with respect to axis $X_2$–$X'_2$ in the direction of the edge 22 and divergent in the direction of the body 11 of the bottle 1. The neck 2 also comprises a part 27 recessed towards the inside of the neck 2 with respect to the flange 26, the part 27 being joined by a substantially truncated part 28 to a bead 29 forming the base of the neck 2.

24*a* denotes the outer surface of the part 24. 26*a* denotes the substantially annular surface of the flange 26 turned towards the body 11, this surface being substantially perpendicular to axis $X_2$–$X'_2$.

The device of the invention also comprises a pourer 3 and an assembly 4 forming cover made of plastics material. The pourer 3 is moulded from low density polyethylene while assembly 4, which is in one piece, is moulded from high or medium density polyethylene. Other materials may be used for moulding the elements 2, 3 and 4, the material of the pourer 3 remaining less rigid than those of the neck 2 and of the assembly 4.

The pourer 3 is cylindrical and symmetrical about an axis $X_3$–$X'_3$ merged with axis $X_2$–$X'_2$ when the pourer 3 is mounted on the neck 2. The pourer 3 comprises a part 31 with substantially rectilinear generatrix whose edge 32 opposite the body 11 is curved outwards, with the result that it forms a surface 32*a* for flow of the milk without contact with the neck 2. When the pourer 3 is mounted on the neck 2, the part 31 is disposed partially inside the neck 2.

From a median zone of the part 31, a skirt 33 intended to cover the zone 21 extends radially outwards, the skirt being provided, at the level of its edge 34 distant from the part 31 with a flange 36 extending radially outwards from the edge 34. The flange 36 comprises an upper surface 36*a* of annular shape and substantially perpendicular to axis $X_3$–$X'_3$.

In the present specification, the adjectives upper and lower correspond to the orientation of the Figures, the lower side of an element being oriented towards the body 11 while its upper side is oriented opposite the latter.

The edge 34 defines an inner truncated surface 34*a* converging towards axis $X_3$–$X'_3$ in the direction of the upper edge 32 of the pourer, the surface 34*a* extending up to an inner circlip 33*a* of the skirt 33.

The apex angle $\alpha$ of the surface 34*a* is substantially equal to the apex angle $\beta$ of the surface 24*a*.

A membrane 37 is joined to the part 31 by a zone 37*a* of privileged rupture, this membrane making it possible to isolate the inner volume of the body 11 of the bottle 1 as long as it remains in place. The membrane 37 is fast with a grip ring 38 in which a user can pass a finger to exert a force $F_1$ directed opposite the body 11 in order to remove this membrane when the milk contained in the bottle is to be used.

The assembly 4 comprises a ring 41 intended to be disposed around the neck 2, this ring being provided with two catching string rims 411 and 412 which extend radially inwards from the latter, The ring 41 is substantially cylindrical and the rim 411 is formed in the vicinity of the lower edge 413 of the ring 41. The rim 411 forms a substantially truncated surface 411*a* divergent in the direction of the edge 413. The rim 411 also forms an annular upper surface 411*b* substantially perpendicular to a central axis $X_4$–$X'_4$ of the assembly 4.

As for the rim 412, it forms a truncated surface 412*a* centred on the axis $X_4$–$X'_4$ and converging in the direction of the edge 413 and an annular surface 412*b* substantially perpendicular to the axis $X_4$–$X'_4$. In this way, a concave volume V is defined, on the lower periphery of the ring 41, between the surfaces 411*b* and 412*b* of the rims 411 and 412.

The ring 41 is joined by a hinge 42, formed by an elastically deformable thinned zone, to a substantially cylindrical cap 43. Before the first use of the bottle, the cap is joined by a band 44 to the ring 41 over virtually the whole of the circumference of this ring. The band 44 is respectively joined by two frangible zones 44*a* and 44*k* to the ring 41 and to the stopper 43. A tongue 44*c* makes it possible to remove the band 44 by rupture of the zones 44*a* and 44*b*, which allows a movement of pivoting of the cap about axis $X_{12}$–$X'_2$ of the hinge 42, between the positions of FIGS. 1 and 2.

Figure 2:
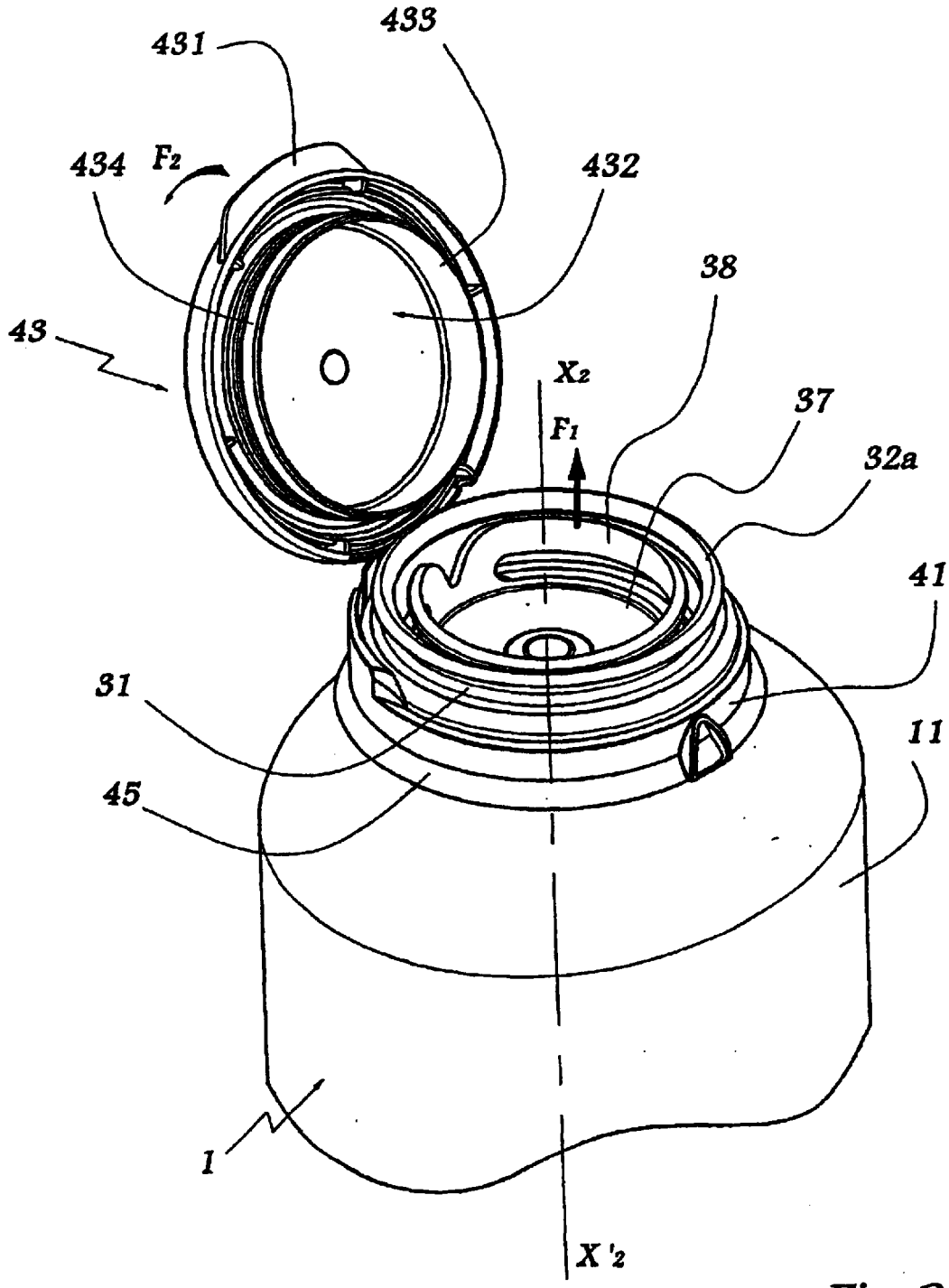
FIG. 2 is a view similar to FIG. 1 while the cap is in a second position.
Figure 3:
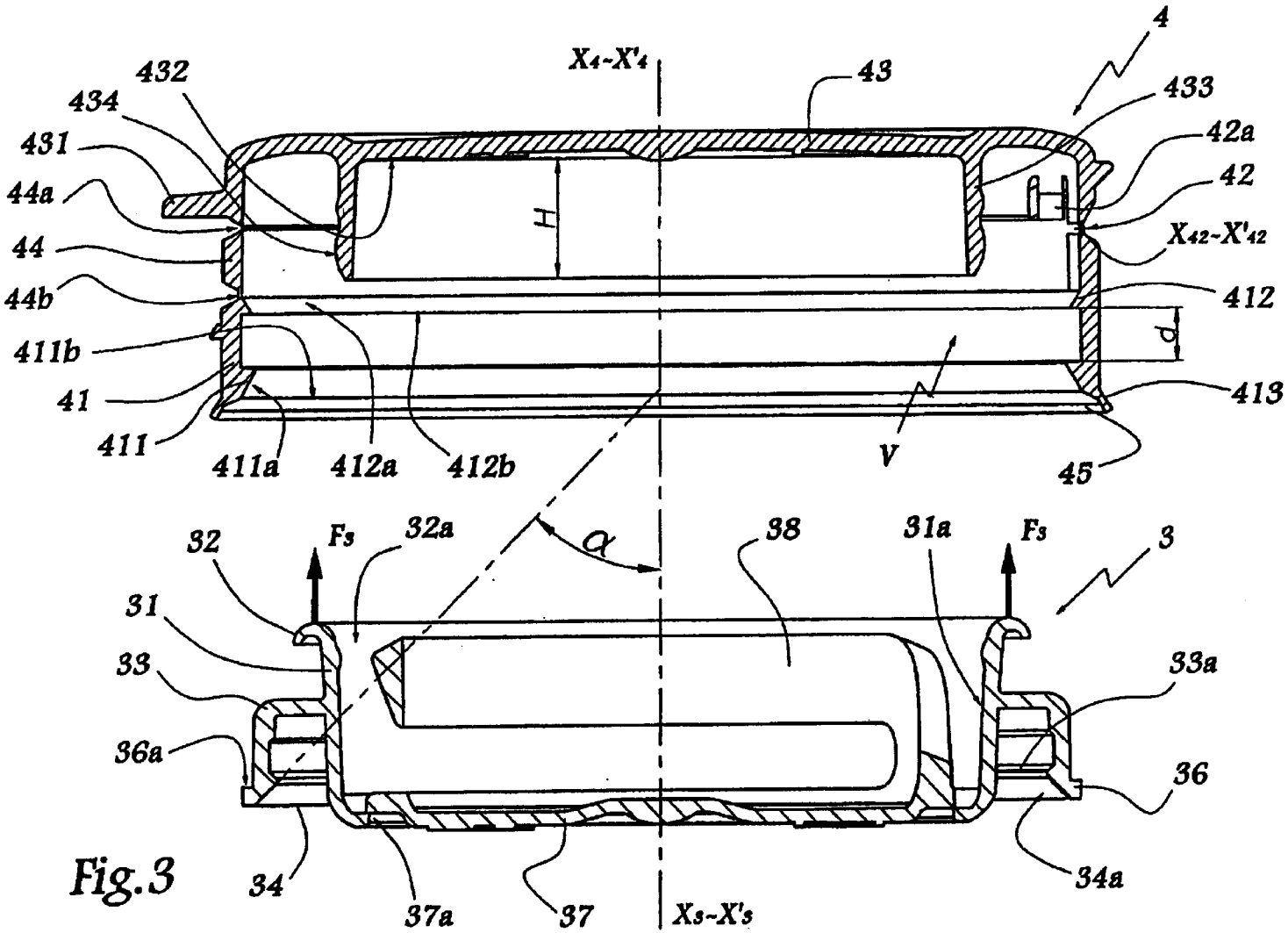
FIG. 3 is an exploded section, along line III—III in FIG. 1, of the closure device.

The hinge 43 may be associated with bistable tongues of which only one appears in FIG. 3 with reference 42*a*, which makes it possible to conserve the orientation of the cap 43 in each of the positions shown in FIGS. 1 and 2.

The cap 43 is equipped with a tongue or "peaked cap" 431 making it possible to lift it by a force $F_2$ shown in FIG. 2.

Figure 4:
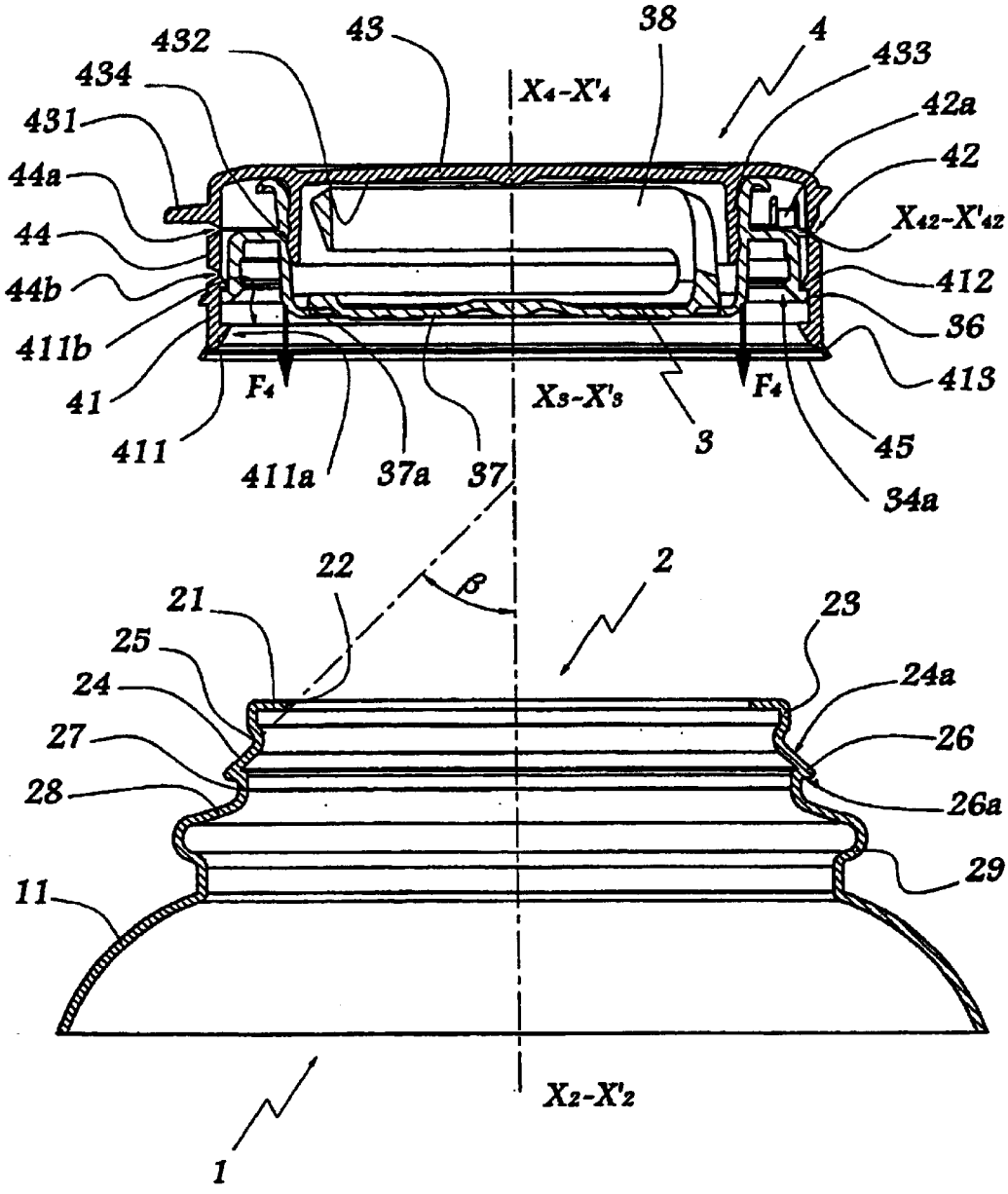
FIG. 4 is a section of the device of FIGS. 1 to 3 in the course of assembly on the neck of the bottle.

The pourer 3 and the assembly 4 are pre-assembled by introduction of the pourer in the inner volume of the assembly 4, in a translation parallel to axes $X_3$–$X'_3$ and $X_4$–$X'_4$ as represented by arrows $F_3$ in FIG. 3. The structure formed by elements 3 and 4 is then displaced in translation, parallel to axes $X_2$–$X'_2$, $X_3$–$X'_3$ and $X_4$–$X'_4$, in the direction of the neck 2, as represented by arrows $F_4$ in FIG. 4.

At the end of this translation, the skirt 33 covers the upper part of the jack 2, i.e. parts 21 to 23, the surfaces 34*a* and 24*a* in that case being in surface abutment, which is possible due to the equality of the angles $\alpha$ and $\beta$. The positioning of the pourer 3 on the neck 2 does not necessitate deforming this neck or this pourer.

Figure 5:
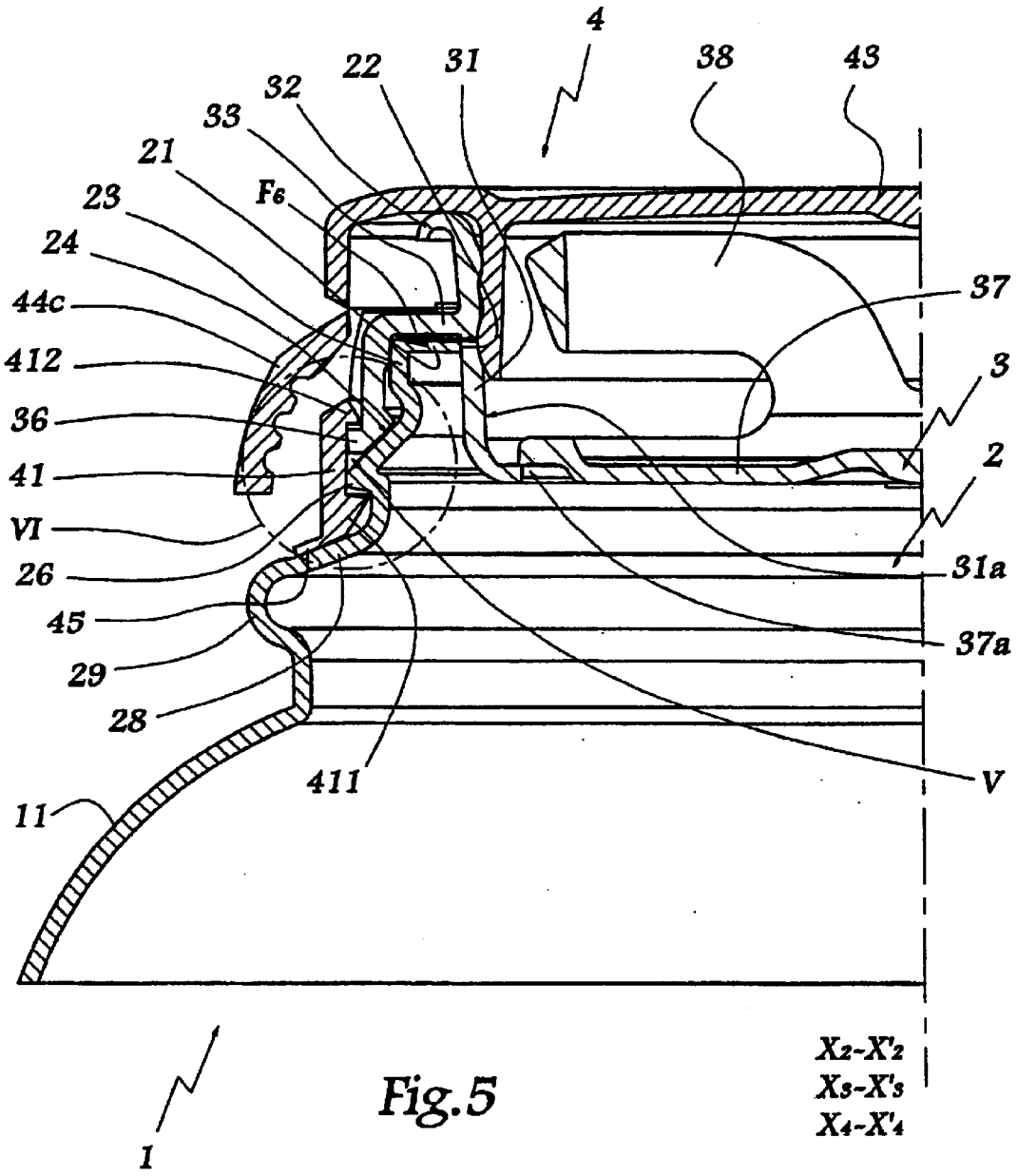
FIG. 5 is a half-section on a larger scale along line V—V in FIG. 1.

In the course of the translation in the direction of arrows $F_4$, the surface 411*a* of the rim 411 comes into abutment against the flange 36 and the flared nature of the surface 411*a* allows a progressive radial expansion of the edge 413 of the ring 41. The ring 41 progresses in the direction of the body 11 until the rim 11 projects beyond the flange 26, with the result that the surface 411*b* comes opposite the surface 26*a*. The ring 41 is in that case locked on the neck 2 as shown in FIG. 5. It cannot be torn away by a force in a direction opposite to arrows $F_4$ in FIG. 4, as the surfaces 411*b* and 26*a* contribute to an efficient locking of the rim 411 at the level of part 27 of the neck 2.

The geometry of the volume V, i.e. in particular the distance d between the surfaces 411*b* and 412*b*, is chosen so that, when the rim 411 is in place at the level of the surface 27, the surface 412*b* comes opposite the surface 36*a*, so that the edge 34 of the skirt 33 is maintained in abutment on or at a short distance from the truncated part 24 of the neck 2. The pourer 3 is thus locked in position on the neck 2 by the cooperation of the rims 411 and 412.

Figure 6:
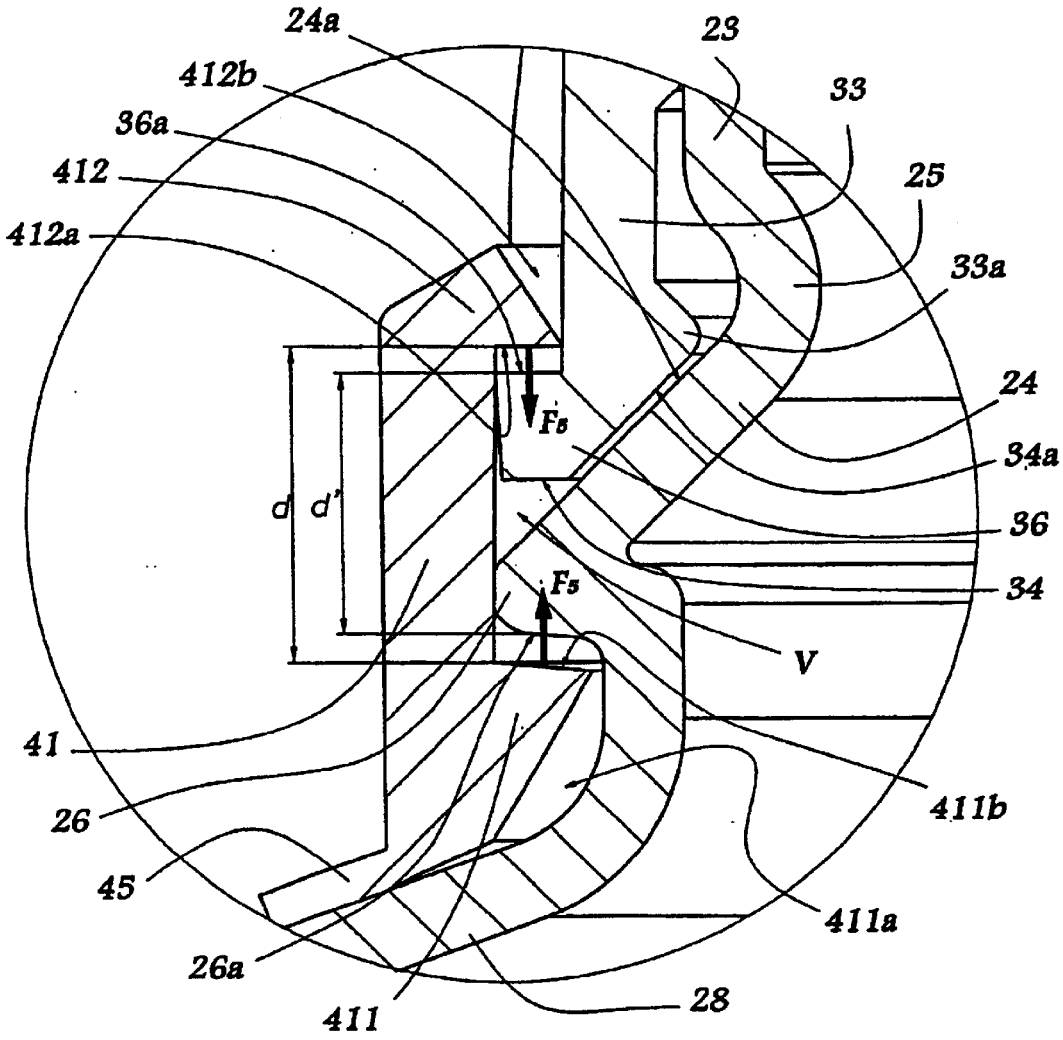
FIG. 6 is a view on a larger scale of detail VI in FIG. 5.

The distance d' between the surfaces 26*a* and 63*a*, when the device is in mounted configuration as shown in FIGS. 5 and 6, is chosen to be shorter than or equal to the distance d.

As shown in FIG. 6, the beads 411 and 412 are adapted to exert on the flanges 26 and 36 a force $F_5$ tending to oppose a moving apart of the flanges 26 and 36. In this direction, the force $F_5$ is a force of clamping of the flanges 26 and 36 one in the direction of the other.

At the level of its lower edge, the ring 41 extends in a supple skirt 45 provided to come into abutment against the body 11. The skirt 45 is deformed during positioning of the assembly 4, to follow the geometry of the part 28 as shown in FIGS. 5 and 6. The skirt 45 limits the access to the rim 411, which avoids fraudulent manipulations of the closure device.

On its inner surface 432, the cap 42 is equipped with a skirt 433 of which the height H is such that it extends to this side of the edge 22 when the cap is bent down on the pourer 3, the skirt 433 being equipped with an outer bead 434 making it possible to exert on the inner radial surface 31*a* of the part 31, a centrifugal force $F_6$ tending to apply the pourer 3 on the edge 22, which guarantees tightness between the neck 2 and the pourer 3, on the one hand, and between the pourer 3 and the cap 43, on the other hand.

The pourer 3, on the one hand, and the assembly forming cap, on the other hand, are each made in one piece by moulding, with the result that it is easy to manipulate them and position them on the neck.

The invention has been described with an assembly forming hinged cap. However, it is applicable with a screwed cap, belonging to an assembly forming cover equipped with a ring for retaining on the neck of a container.

The invention has been shown with catching rims 411 and 412 extending over the whole inner circumference of the ring 41. However, such rims might be interrupted or extend over only a part of this circumference.

What is claimed is:

1. Device for closing a container (1) provided with a neck (2), said device comprising a pourer (3), adapted to be mounted on said neck, and an assembly (4) forming cover adapted to be mounted on said neck and comprising a cap (43) mobile between a first position where it isolates said neck and said pourer from the outside and a second position where it allows access to said neck and to said pourer, characterized in that said assembly forming a cover comprises two catching string rims (411, 412), extending radially inwards from a ring (41), a first rim (411) being adapted to be engaged with an external flange (26) of said neck, while a second rim (412) is adapted to be engaged with an external flange (36) of said pourer, said first and second rims defining between them a volume (V) for receiving said flanges.

2. Device according to claim 1, characterized in that said catching rims (411, 412) are adapted to exert on said flanges (26, 36) a force ($F_5$) opposing their relative spacing apart.

3. Device according to claim 1, characterized in that said first rim (411) forms a surface **(411*a*) inclined with respect to a central axis ($X_4$–$X'_4$) of said device, said surface being flared in the direction of the body (11) of said container (1)**.

4. Device according to claim 1, characterized in that said first and second rims each form a surface **(411*b*, 412*b*)** substantially perpendicular to said central axis ($X_4$–$X'_4$) of said device.

5. Device according to claim 4, characterized in that said surfaces **(411*b*, 412*b*)** substantially perpendicular to said central axis ($X_4$–$X'_4$) are opposite one another and said receiving volume (V) is defined between them.

6. Device according to claim 1, characterized in that said flange (36) of said pourer (3) extends radially outwards from an edge (34) of a skirt (33) formed by said pourer and adapted to cover said neck (2).

7. Device according to claim 6, characterized in that said skirt (33) forms a surface **(34*a*) inclined with respect to a central axis ($X_3$–$X'_3$) of the device, said surface being adapted to come into surface abutment against an outer inclined surface (24*a*) of said neck (2)**.

8. Device according to claim 1, characterized in that said ring (41) extends, opposite said cap (43), by a skirt (45) adapted to come into abutment against the outer surface of a part (28) of said container (1).

9. Device according to claim 1, characterized in that said pourer (3) is disposed at least partially inside said neck (2) and in that said cap (43) is provided with a skirt (433) extending, in said first position and from an inner surface (432) of said cap, up to the level of an edge (22) of said neck, the skirt being adapted to exert, in said first position and against an inner radial surface **(31*a*)** of the pourer, a force ($F_6$) tending to apply said pourer against said edge.

10. Container for liquid (1), particularly bottle made of plastics material, equipped with a closure device (2–4) according to claim 1.

* * * * *